US006150079A

United States Patent [19]

Bergthaller

[11] Patent Number: 6,150,079

[45] Date of Patent: Nov. 21, 2000

[54] COLOR PHOTOGRAPHIC RECORDING MATERIAL

[75] Inventor: Peter Bergthaller, Bergisch Gladbach, Germany

[73] Assignee: Agfa Gevaert N.V, Belgium

[21] Appl. No.: 09/227,469

[22] Filed: Jan. 8, 1999

[30] Foreign Application Priority Data

Jan. 16, 1998 [DE] Germany ..... 198 01 352

[51] Int. Cl.[7] ..... G03C 1/08; G03C 7/26; G03C 7/32

[52] U.S. Cl. ..... 430/558; 430/505; 430/544; 430/955; 430/956; 430/957; 430/958

[58] Field of Search ..... 430/543, 550, 430/505, 544, 955, 956, 957, 950

[56] References Cited

U.S. PATENT DOCUMENTS

| | | | |
|---|---|---|---|
| 5,256,526 | 10/1993 | Suzuki et al. | 430/558 |
| 5,362,882 | 11/1994 | Suzuki et al. | 430/558 |
| 5,660,975 | 8/1997 | Ito et al. | 430/544 |
| 5,691,125 | 11/1997 | Hara et al. | 430/505 |

FOREIGN PATENT DOCUMENTS

| | | |
|---|---|---|
| 710 881 | 5/1996 | European Pat. Off. . |
| 714 892 | 6/1996 | European Pat. Off. . |
| 883 024 | 12/1998 | European Pat. Off. . |

*Primary Examiner*—Geraldine Letscher
*Attorney, Agent, or Firm*—Connolly Bove Lodge & Hutz LLP

[57] ABSTRACT

A color photographic material, the cyan coupler of which is of the formula (II)

in which $R_{11}$ means an alkyl, aryl, acylamino, alkylcarbamoyl, arylcarbamoyl or a heterocyclic group, $R_{12}$ means a group having electron-attracting characteristics, $R_{13}$ means a group having electron-attracting characteristics, $R_{14}$ means an alkyl or aryl group, $R_{15}$ means a divalent linking member having 2 to 4 linking atoms, X means =O or =N—$SO_2R_{21}$ and Y means a group eliminable by hydrolytic or intramolecular (nucleophilic) attack,
is distinguished by improved processing stability.

4 Claims, No Drawings

COLOR PHOTOGRAPHIC RECORDING MATERIAL

This invention relates to a colour photographic recording material containing a 2-equivalent cyan coupler, which material is distinguished by improved processing stability.

Novel 2-equivalent cyan couplers of the formula I are known from EP 710 881 and EP 714 892

(I)

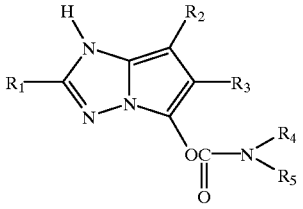

in which $R_1$ means an aliphatic or aromatic groups, an alkoxycarbonyl or carbamoyl group $R_2$ and $R_3$ mean an electron-attracting group, $R_4$ and $R_5$ mutually independently mean a hydrogen atom, an aliphatic, aromatic or heterocyclic group or together mean the remaining members of a ring.

These couplers yield excellent photographic results, especially at low silver application rates. However, they do result in processing instability.

The object was to provide colour couplers which have the advantages of the colour couplers of the formula I, but without exhibiting the disadvantages thereof.

It has now been found that this may be achieved with the couplers of the formula II.

The present invention accordingly provides a colour photographic material which contains on a support at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler together with conventional non-photosensitive layers, characterised in that the cyan coupler, of which there is at least one, is of the formula (II)

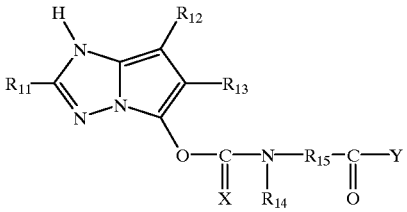

in which $R_{11}$ means an allyl, aryl, acylarnino, alkylcarbamoyl, arylcarbamoyl or a heterocyclic group, $R_{12}$ means a group having electron-attracting characteristics, $R_{13}$ means a group having electron-attracting characteristics, $R_{14}$ means an alkyl or aryl group, $R_{15}$ means a divalent linking member having 2 to 4 linking atoms, X means =O or =N—$SO_2R_{21}$ and Y means a group eliminable by hydrolytic or intramolecular (nucleophilic) attack.

$R_{12}$ in particular has one of the following meanings:

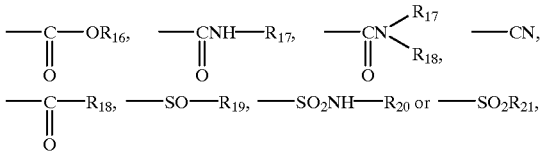

in which $R_{16}$, $R_{17}$, $R_{18}$, $R_{19}$, $R_{20}$ and $R_{21}$ mutually independently mean preferably aliphatic ballast groups together having at least 8 C atoms.

$R_{13}$ is in particular a cyano, alkoxycarbonyl or aryloxycarbonyl group.

$R_{15}$ is in particular an ethylene or trimethylene group.

Y is in particular an alkoxy or aryloxy group or a group of the formulae

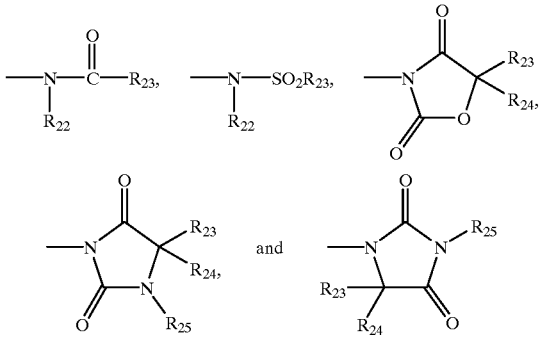

in which $R_{22}$, $R_{23}$, $R_{24}$ and $R_{25}$ mutually independently mean alkyl groups or, in pairs, mean alkylene groups.

X is in particular O.

Further preferred embodiments are disclosed in the subordinate claims.

Examples of cyan couplers according to the invention are:

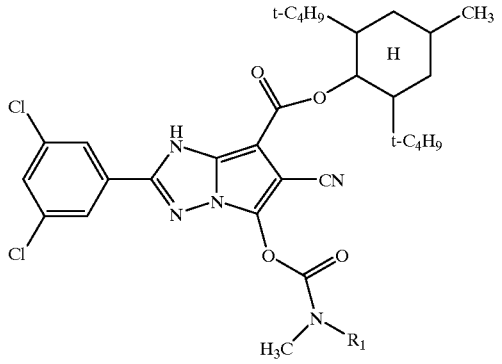
| Coupler | $R_1$ |
|---|---|
| II-1 | $—(CH_2)_2COOCH3$ |
| II-2 | $—CH(CH_3)CH_2COOCH_3$ |
| II-3 | $—(CH_2)_3COOCH_3$ |
| II-4 | $—(CH_2)_2COOCH_2CF_3$ |
| II-5 | $—(CH_2)_2COOCH_2$-phenyl |
| II-6 | $—(CH_2)_2CON(CH_3)SO_2$-phenyl |
| II-7 | $—(CH_2)_2OCOOCH_3$ |
| II-8 | 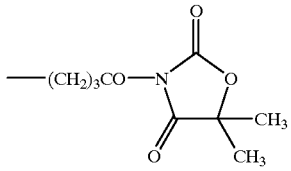 |
| II-9 | 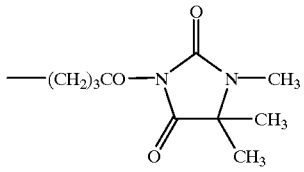 |
| II-10 | $—(CH_2)_3CON(CH_3)COOCH_3$ |
| II-11 | 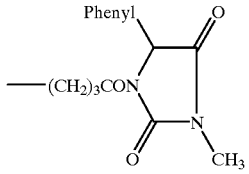 |
| II-12 | 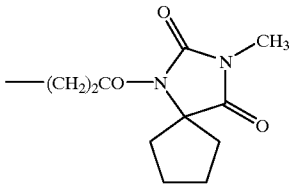 |
| II-13 | $—(CH_2)_2CON(CH_3)SO_2N(CH_3)_2$ |

-continued
| Coupler | $R_1$ |
|---|---|
| | 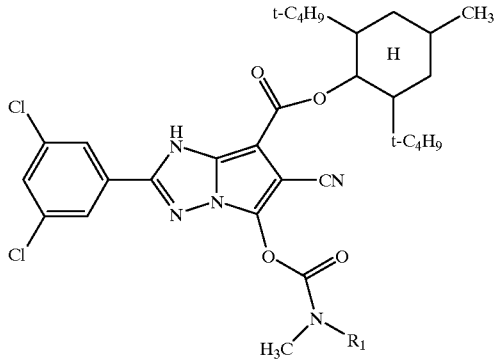 |
| II-14 | 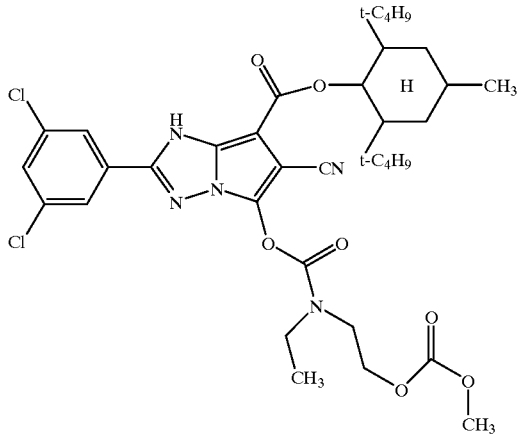 |
| II-15 | 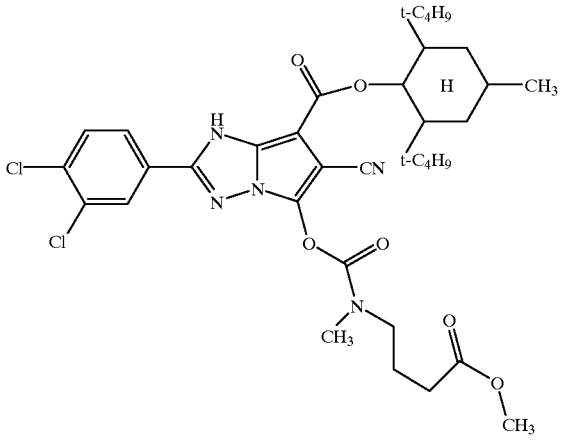 |

-continued
| Coupler | $R_1$ |
|---|---|
| | 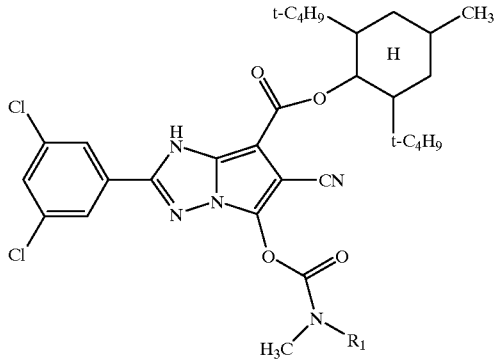 |
| II-16 | 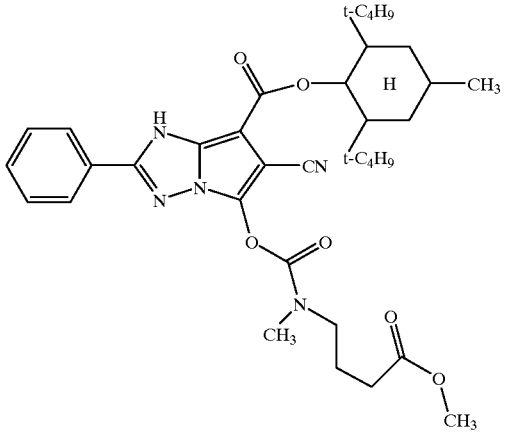 |
| II-17 | 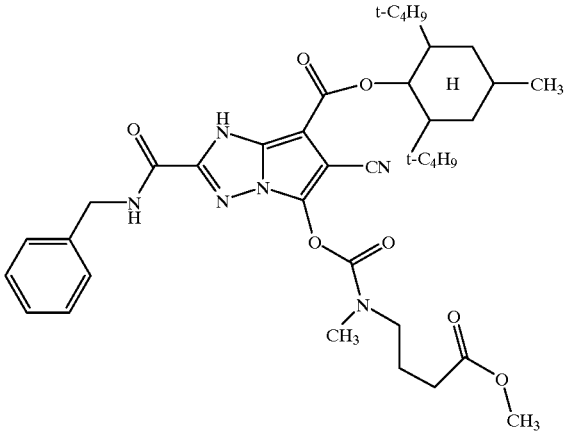 |

-continued
| Coupler | $R_1$ |
|---|---|
| | 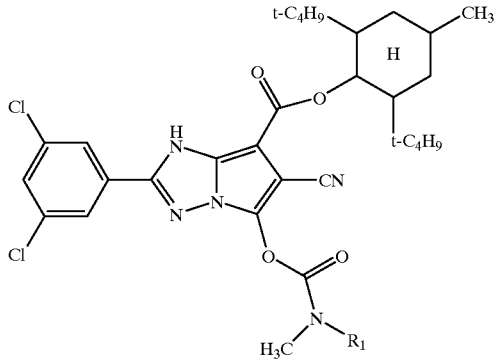 |
| II-18 | 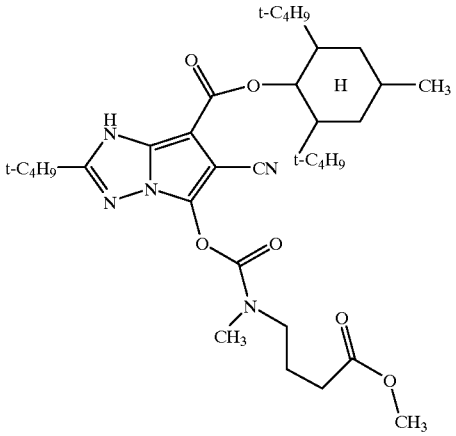 |
| II-19 | 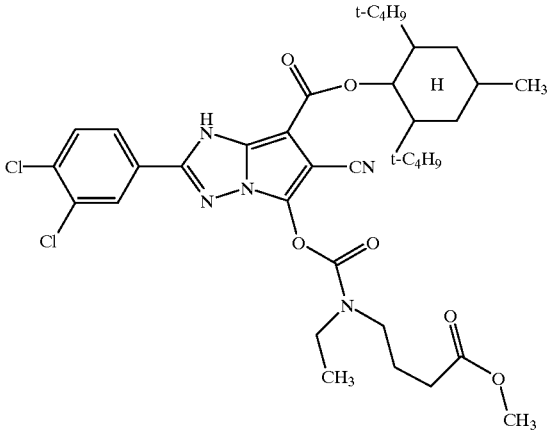 |

-continued
| Coupler | $R_1$ |
|---|---|
| | 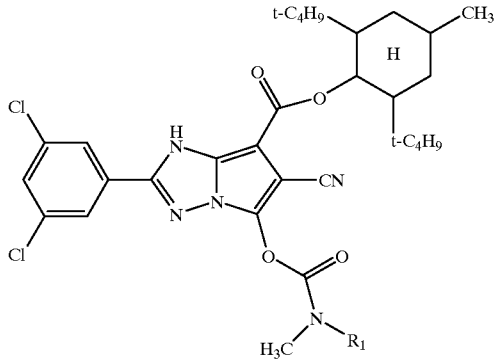 |
| II-20 | 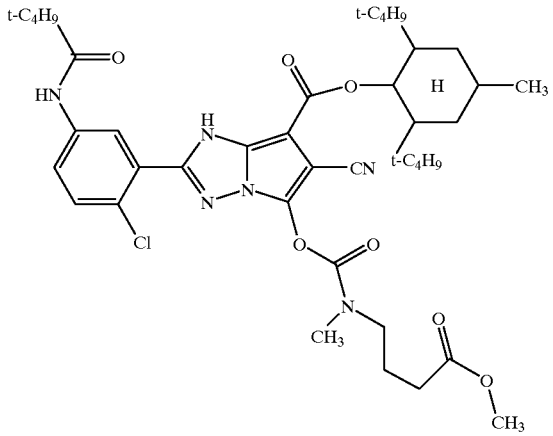 |
| II-21 | 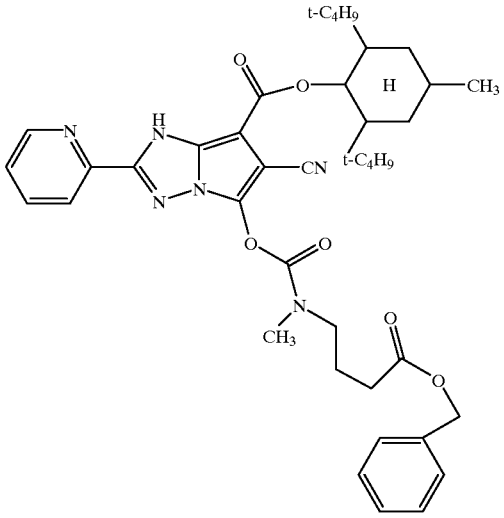 |

-continued
| Coupler | $R_1$ |
|---|---|
| | 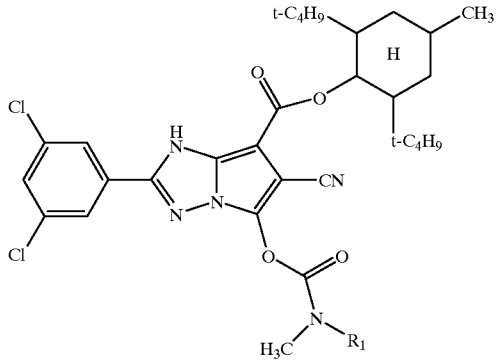 |
| II-22 | 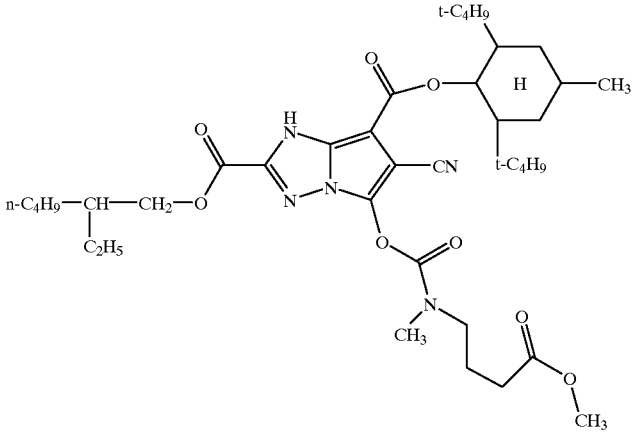 |
| II-23 | 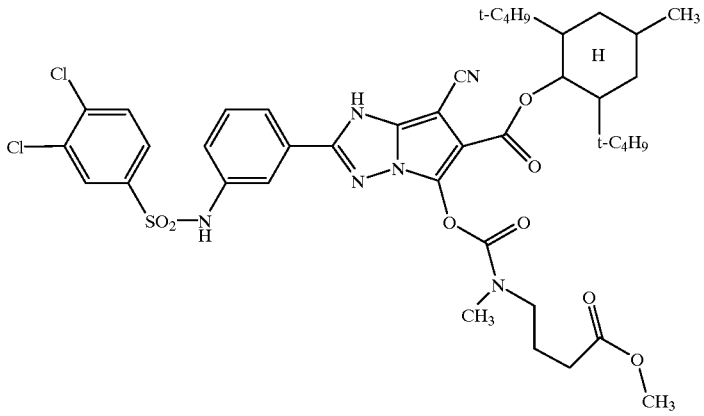 |

-continued
| Coupler | $R_1$ |
|---|---|
| | 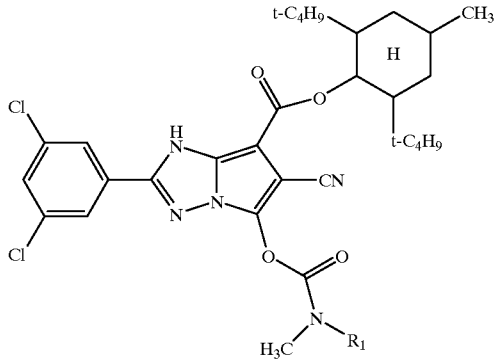 |
| II-24 | 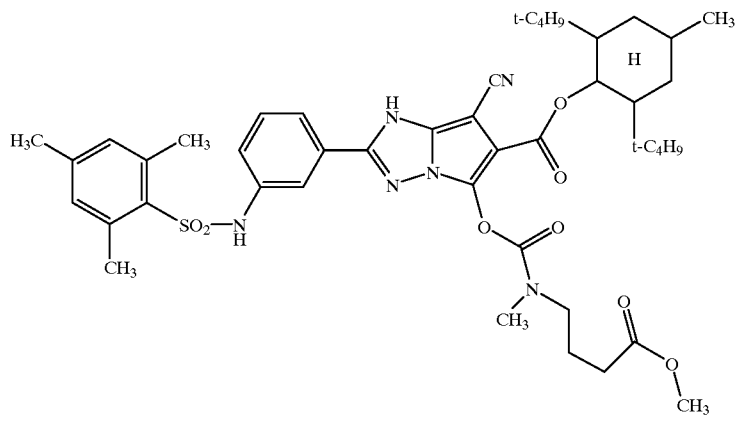 |
| II-25 | 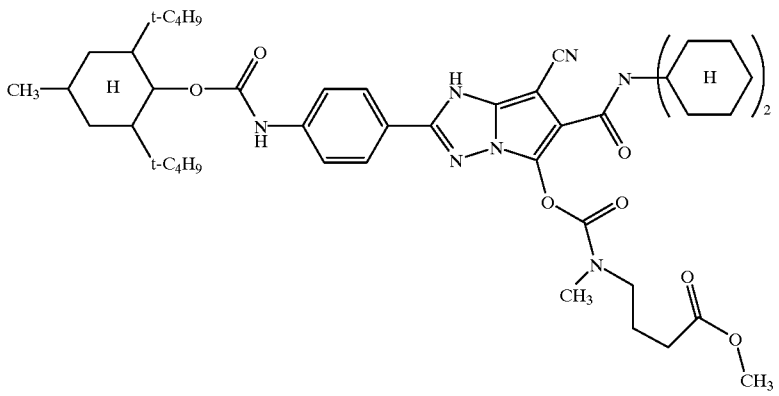 |

-continued
| Coupler | $R_1$ |
|---|---|
| 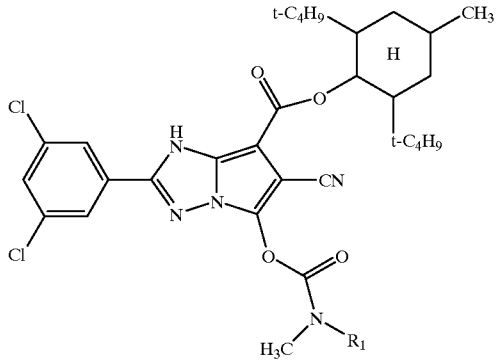 | |
| II-26 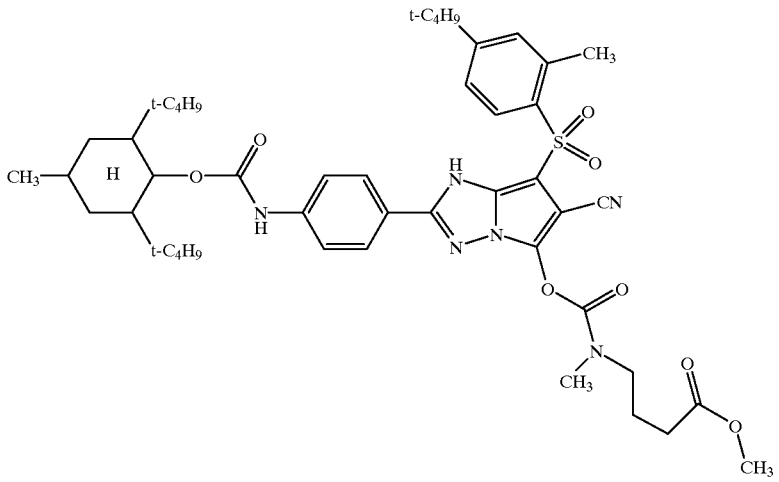 | |
| II-27 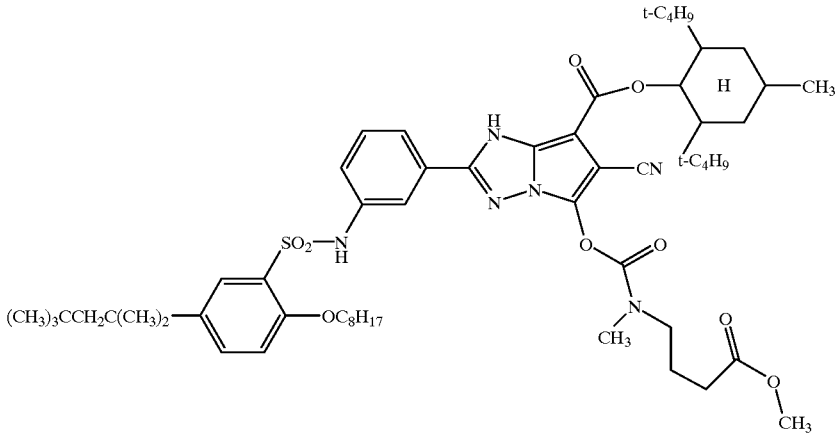 | |

-continued
| Coupler | $R_1$ |
|---|---|
| | 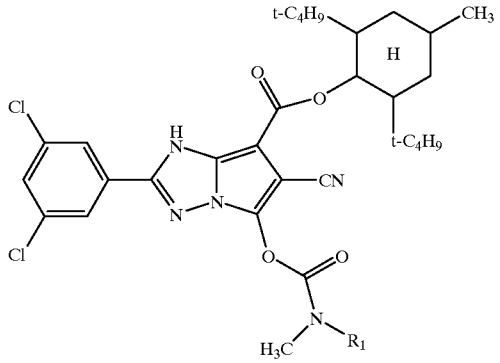 |
| II-28 | 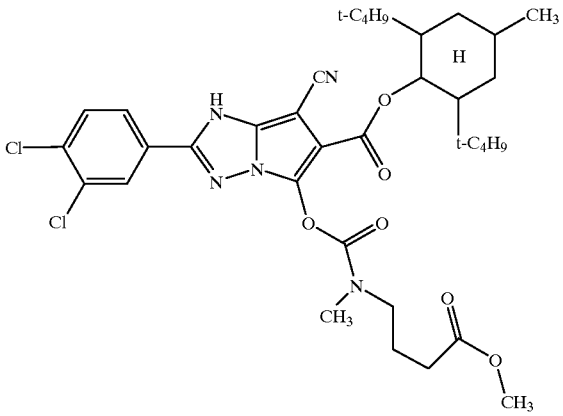 |
| II-29 | 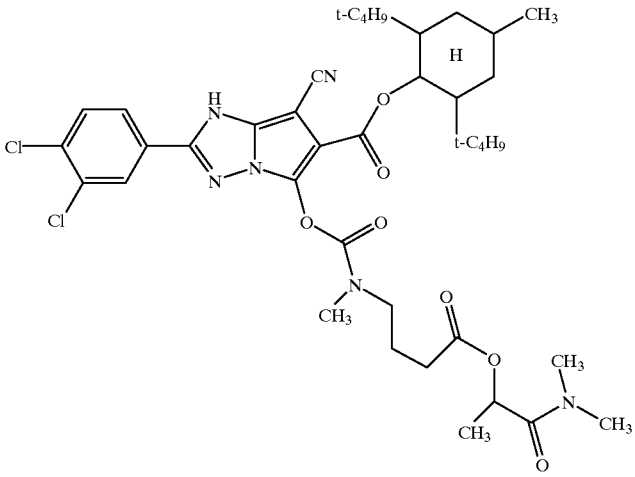 |

-continued

| Coupler | $R_1$ |
|---|---|
| | 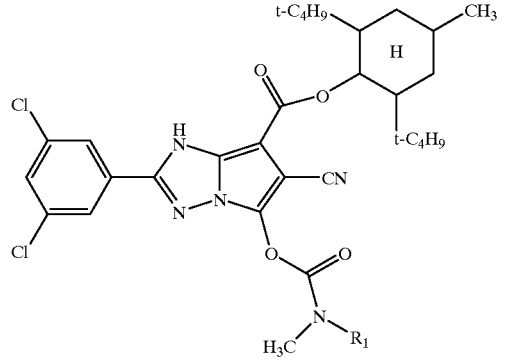 |
| II-30 | 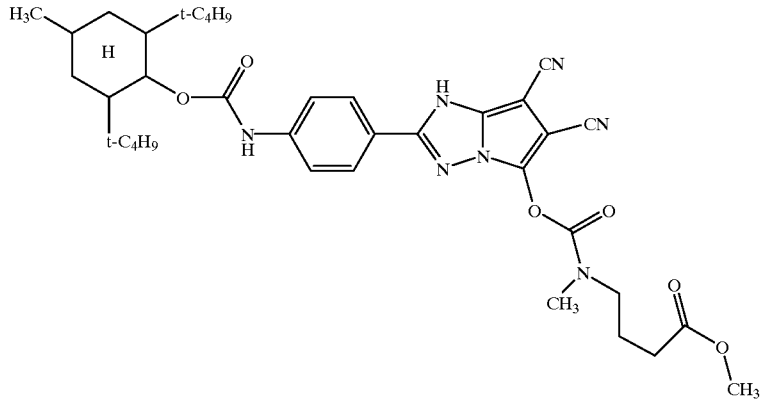 |
| II-31 | 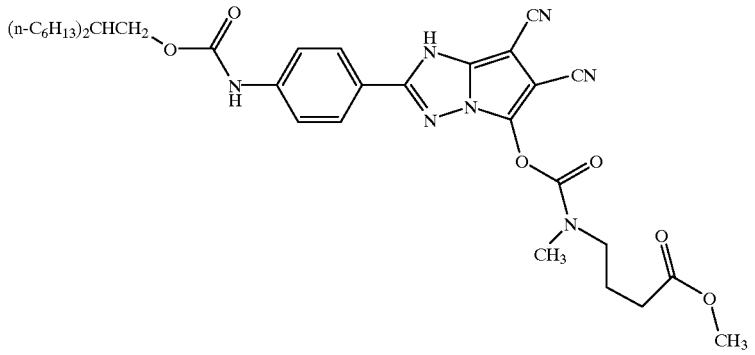 |

Production of coupler II-1

14.5 g of 4-dimethylaminobutyric acid ester are added dropwise at 0° C. over a period of 1 hour to a solution of 12 g of phosgene and 0.25 g of activated carbon in 72 ml of dichloromethane. The mixture is left to stand for 48 hours, 20 ml of dichloromethane are evaporated off, the activated carbon is filtered out with exclusion of moisture and the mixture evaporated under standard pressure. N-chloroformyl4-methylaminobutyric acid is obtained, which is further processed in the crude state.

4.8 g of 3-(3,5-dichlorophenyl)-1-1,2,4-triazole-5-acetic acid (2,6-di-t-butyl-4-methyl)-cyclohexyl ester (produced according to EP 714 892, page 43) are reacted with 2.0 g of bromine in 180 ml of tetrahydrofuran, wherein a crude monobromine compound is obtained which contains considerable proportions of dibrominated compound together with unreacted starting material. The mixture is evaporated under a vacuum, the residue redissolved in 100 ml of ethyl acetate and 10 ml of methanol, the solution shaken with 100 ml of 5 wt. % sodium acetate solution, the ethyl acetate phase separated, the mixture rewashed with 50 ml of water, dried with a total of 4 g of magnesium sulfate and evaporated under a vacuum. 3-(3,5-dichlorophenyl)-1-1,2,4-triazole-5-bromoacetic acid (2,6-di-t-butyl-4-methyl) cyclohexyl ester is obtained as the residue.

The residue is dissolved under nitrogen as protective gas in 100 ml of anhydrous tetrahydrofuran, 2 ml of cyanoacetic acid methyl ester are added and the mixture stirred at 0° C. with the addition of 1.3 g of potassium t-butylate. The temperature is allowed to rise to room temperature, the dark brown solution is poured into 200 ml of 2 wt. % acetic acid, the oil phase is separated by stirring in 50 ml of ethyl acetate, the separated organic phase is washed twice with 100 ml portions of water, dried twice with 2 g portions of magnesium sulfate and evaporated. The residue amounts to 4.15 g.

The evaporation residue is stirred together with 100 ml of methanol and 1 g of sodium hydroxide and the solution is left to stand overnight. 100 ml of ethyl acetate and 100 ml of 2 wt. % hydrochloric acid are added, the ethyl acetate phase is separated, washed twice with 100 ml portions of 2 wt. % magnesium sulfate solution, dried with 4 g of magnesium sulfate, filtered and evaporated under a vacuum.

4.25 g (0.022 mol) of N-chloroformyl-4-methylarninobutyric acid ester (see above) are added dropwise at 0° C. to 100 ml of pyridine, after 1 hour the temperature is allowed to rise to 10° C. and the evaporation residue described above, dissolved in 20 ml of tetrahydrofuran, is added. The mixture is stirred overnight at room temperature, the solution is discharged onto 400 g of ice and, once all the ice has melted, redissolved with 100 ml of ethyl acetate. The ethyl acetate phase is washed twice with 100 ml portions of water, then once with 50 ml of 10 wt. % common salt solution and dried twice with 5 g portions of sodium sulfate. The mixture is evaporated under a vacuum, redissolved in 200 ml of cyclohexane and 50 ml of toluene and the components of the product mixture are separated by column chromatography on 300 g of silica gel with cyclohexane/toluene as the mobile solvent.

The product, which is identifiable by a bluish fluorescence in the eluates, is obtained after evaporation as 1.2 g of a slightly reddish, semi-crystalline mass.

Examples of colour photographic materials are colour negative films, colour reversal films, colour positive films, colour photographic paper, colour reversal photographic paper, colour-sensitive materials for the dye diffusion transfer process or the silver dye bleaching process. A review is given in *Research Disclosmire* 37038 (1995) and *Research Disclosure* 38957 (1996).

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

A yellow filter layer, which prevents blue light from reaching the underlying layers, is conventionally located between the green-sensitive and blue-sensitive layers.

Possible options for different layer arrangements and the effects thereof on photographic properties are described in *J. Inf. Rec. Mats.,* 1994, volume 22, pages 183–193 and in *Research Disclosure* 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part II.A (1996), page 598.

Details of suitable silver halide emulsions, the production, ripening, stabilisation and spectral sensitisation thereof, including suitable spectral sensitisers, may be found in *Research Disclosure* 37254, part 3 (1995), page 286, in *Research Disclosure* 37038, part XV (1995), page 89 and in *Research Disclosure* 38957, part V.A (1996), page 603.

Photographic print materials contain either silver chloride-bromide emulsions with up to 80 mol. % of AgBr or silver chloride-bromide emulsions with above 95 mol. % of AgCl.

Details relating to colour couplers may be found in *Research Disclosure* 37254, part 4 (1995), page 288, in *Research Disclosure* 37038, part II (1995), page 80 and in *Research Disclosure* 38957, part X.B (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

Details relating to such compounds, in particular couplers, may be found in *Research Disclosure* 37254, part 5 (1995), page 290, in Research Disclosure 37038, part MV (1995), page 86 and in Research Disclosure 38957, part X.C (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present in the layers as fine droplets (0.05 to 0.8 $\mu$m in diameter).

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part X.D (1996), pages 621 et seq.

The photographic material may also contain UV light absorbing compounds, optical brighteners, spacers, filter dyes, formalin scavengers, light stabilisers, anti-oxidants, $D_{min}$ dyes, plasticisers (lattices), biocides and additives to improve the stability of dyes and couplers, to reduce colour fogging and to reduce yellowing and others. Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part II.B (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

The colour photographic material is preferably a colour photographic, negatively developed paper, as is conventionally used for prints, the silver halide emulsions of which consist to an extent of at least 95 mol. % of AgCl.

EXAMPLE

A multi-layer colour photographic recording material was produced by applying the following layers in the stated sequence onto a film support of paper coated on both sides with polyethylene. All quantities are stated per 1 $m^2$; the quantity of silver is stated as $AgNO_3$:

| Sample 1 (Comparison) | |
|---|---|
| 1st layer (substrate layer) | |
| 0.10 g | of gelatine |
| 2nd layer (blue-sensitive layer) | |
| Blue-sensitive silver halide emulsion (99.5 mol. % chloride and 0.5 mol. % bromide, average grain diameter 0.75 μm) prepared from | |
| 0.4 g | of $AgNO_3$ and |
| 1.25 g | of gelatine |
| 0.50 g | of yellow coupler Y-1 |
| 0.45 g | of tricresyl phosphate (TCP) |
| 0.10 g | of stabiliser ST-1 |

-continued

| Sample 1 (Comparison) | |
|---|---|
| 3rd layer (interlayer) | |
| 1.10 g | of gelatine |
| 0.06 g | of oxform scavenger O-1 |
| 0.06 g | of oxform scavenger O-2 |
| 0.12 g | of TCP |
| 4th layer (green-sensitive layer) | |
| Green-sensitised silver halide emulsion (99.5 mol. % chloride, 0.5 mol. % bromide, average grain diameter 0.45 μm) prepared from | |
| 0.20 g | of $AgNO_3$ and |
| 1.00 g | of gelatine |
| 0.05 g | of magenta coupler M-1 |
| 0.10 g | of magenta coupler M-2 |
| 0.40 g | of TCP |
| 0.15 g | of stabiliser ST-2 |
| 0.20 g | of stabiliser ST-3 |
| 5th layer (UV protective layer) | |
| 1.05 g | of gelatine |
| 0.35 g | of UV absorber UV-1 |
| 0.10 g | of UV absorber UV-2 |
| 0.05 g | of UV absorber UV-3 |
| 0.06 g | of oxform scavenger O-1 |
| 0.06 g | of oxform scavenger O-2 |
| 0.25 g | of TCP |
| 6th layer (red-sensitive layer) | |
| Red-sensitised silver halide emulsion (99.5 mol. % chloride, 0.5 mol. % bromide, average grain diameter 0.48 μm) prepared from | |
| 0.28 g | of $AgNO_3$ and |
| 1.00 g | of gelatine |
| 0.40 g | of cyan coupler C-1 |
| 0.40 g | of TCP |
| 7th layer (UV protective layer) | |
| 1.05 g | of gelatine |
| 0.35 g | of UV absorber UV-1 |
| 0.10 g | of UV absorber UV-2 |
| 0.05 g | of UV absorber UV-3 |
| 0.15 g | of TCP |
| 8th layer (protective layer) | |
| 0.90 g | of gelatine |
| 0.05 g | of optical brightener W-1 |
| 0.07 g | of polyvinylpyrrolidone |
| 1.20 ml | of silicone oil |
| 2.50 mg | of spacers (polymethyl methacrylate), average particle size 0.8 μm |
| 0.30 g | of hardener HM-1 |

The substances used in the Examples were of the following formulae:

Y-1
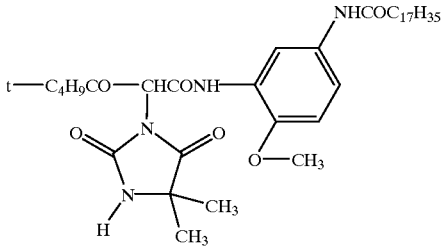
ST-1
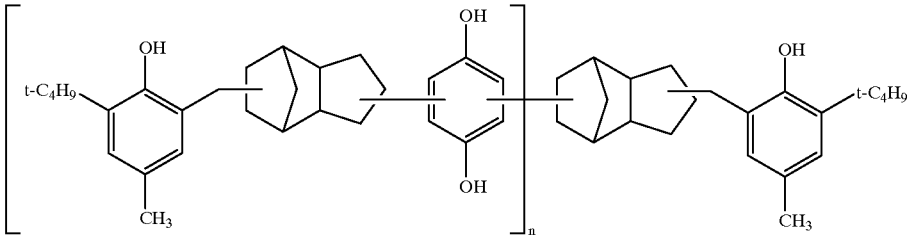
M-1
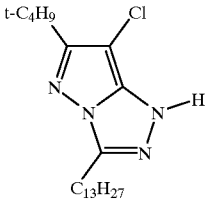
M-2
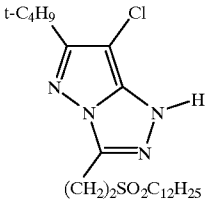
ST-2
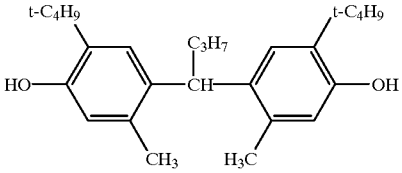
ST-3
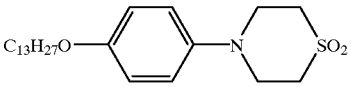
C-1
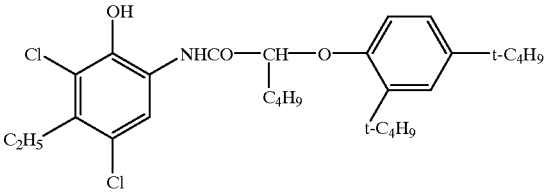
O-1
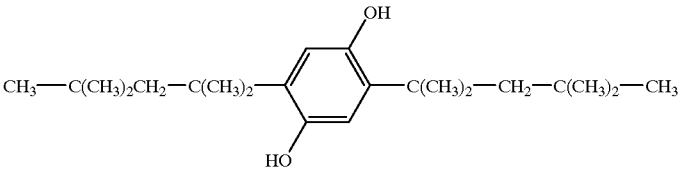
O-2
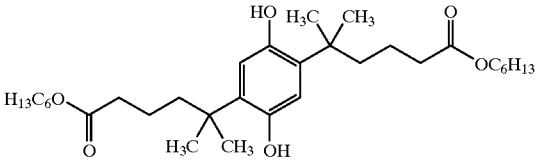
UV-1
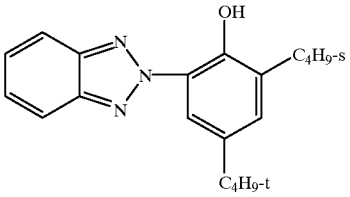

-continued

UV-2

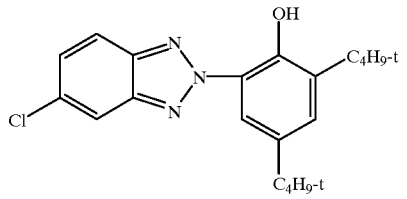

UV-3

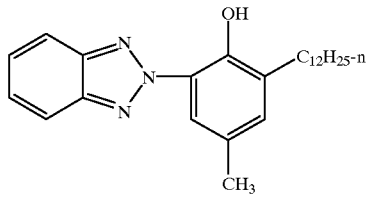

W-1

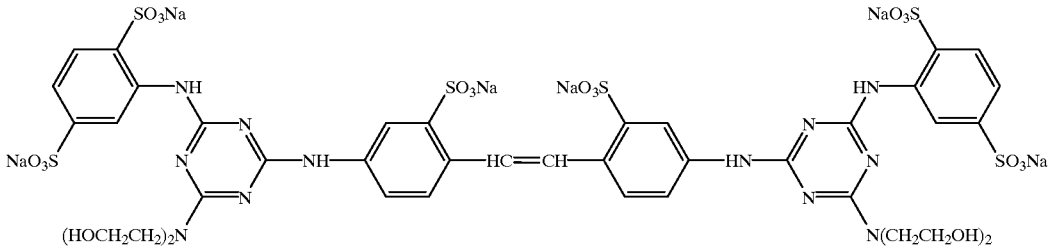

Sample 2 (Comparison)

Sample 2 differs from sample 1 in layer 6:

| | | |
|---|---|---|
| Layer 6: | (Red-sensitive layer) Red-sensitive silver halide emulsion (99.5 mol. % chloride, 0.5 mol. % bromide, average grain diameter 0.48 μm) prepared from | |
| | 0.20 g | of $AgNO_3$ |
| | 1.00 g | of gelatine |
| | 0.32 g | of cyan coupler C-2 |
| | 0.40 g | of TCP |

Sample 3 (Comparison)

Sample 3 differs from sample 1 in layer 6:

| | | |
|---|---|---|
| Layer 6: | (Red-sensitive layer) Red-sensitive silver halide emulsion (99.5 mol. % chloride, 0.5 mol. % bromide, average grain diameter 0.48 μm) prepared from | |
| | 0.20 g | of $AgNO_3$ |
| | 1.00 g | of gelatine |
| | 0.26 g | of cyan coupler C-3 |
| | 0.80 g | of TCP |

Sample 4 (Invention)

Sample 4 differs from sample 1 in layer 6:

| | | |
|---|---|---|
| Layer 6: | (Red-sensitive layer) Red-sensitive silver halide emulsion (99.5 mol. % chloride, 0.5 mol. % bromide, average grain diameter 0.48 μm) prepared from | |
| | 0.20 g | of $AgNO_3$ |
| | 1.00 g | of gelatine |
| | 0.26 g | of cyan coupler II-1 |
| | 0.80 g | of TCP |

The following, substances were first used in samples 2 to 4:

C-2

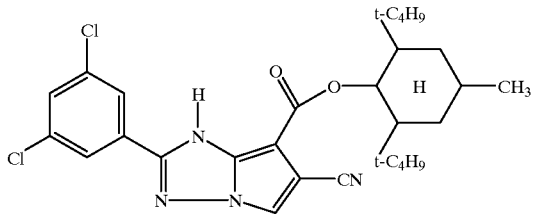

C-3

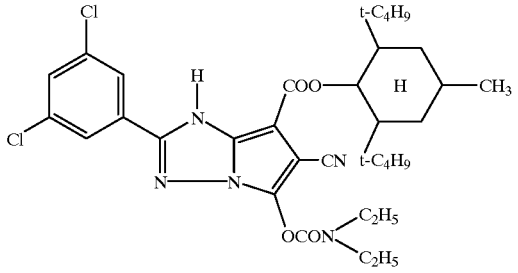

After drying, the individual materials are wound and converted into rolls. One roll each of the materials produced in this manner is exposed in a printer in such a manner that, of 100 shots, 98 are entirely exposed such that a density of 1.5 is obtained, while in two shots, a grey wedge with three adjacently mounted additive colour filters (red, green, blue) is exposed on the samples.

Processing is performed using the AP94 (Agfa) process. 2000 prints are produced from each material, wherein, in order to render the effects more distinct, developer replenishment is reduced by 25% relative to the standard setting. The colour separations of each $99^{th}$ and $100^{th}$ print are then measured (Gretag SPM100-II) and sensitivity (E), gradation (γ) and minimum density ($D_{min}$) determined behind each of the three filters.

The following variations, relative to the $100^{th}$ print, are found after the $500^{th}$, $1000^{th}$, $1500^{th}$ and $2000^{th}$ print:

| Print | Material from | ΔE cyan | ΔE magenta | ΔE yellow | Δγ cyan | Δγ magenta | Δγ yellow | $\Delta D_{min}$ cyan | $\Delta D_{min}$ magenta | $\Delta D_{min}$ yellow |
|---|---|---|---|---|---|---|---|---|---|---|
| 500th print | Sample 1 | −0.02 | −0.02 | −0.04 | −0.10 | −0.12 | −0.12 | 0.01 | 0.00 | 0.00 |
| | Sample 2 | −0.04 | −0.02 | −0.03 | −0.11 | −0.11 | −0.13 | 0.02 | 0.02 | 0.04 |
| | Sample 3 | −0.05 | −0.02 | −0.04 | −0.13 | −0.13 | −0.15 | 0.02 | 0.03 | 0.03 |
| | Sample 4 | −0.05 | −0.03 | −0.03 | −0.05 | −0.10 | −0.10 | 0.01 | 0.01 | 0.01 |
| 1000th print | Sample 1 | −0.04 | −0.03 | −0.05 | −0.16 | −0.15 | −0.20 | 0.03 | 0.05 | 0.03 |
| | Sample 2 | −0.05 | −0.04 | −0.05 | −0.15 | −0.16 | −0.21 | 0.04 | 0.05 | 0.03 |
| | Sample 3 | −0.06 | −0.04 | −0.06 | −0.20 | −0.16 | −0.31 | 0.06 | 0.07 | 0.04 |
| | Sample 4 | −0.04 | −0.03 | −0.04 | −0.14 | −0.15 | −0.22 | 0.03 | 0.04 | 0.03 |
| 1500th print | Sample 1 | −0.08 | −0.04 | −0.08 | −0.20 | −0.20 | −0.28 | 0.06 | 0.05 | 0.05 |
| | Sample 2 | −0.10 | −0.05 | −0.09 | −0.25 | −0.22 | −0.30 | 0.08 | 0.07 | 0.08 |
| | Sample 3 | −0.13 | −0.08 | −0.11 | −0.35 | −0.28 | −0.40 | 0.11 | 0.13 | 0.10 |
| | Sample 4 | −0.07 | −0.03 | −0.09 | −0.27 | −0.22 | −0.25 | 0.07 | 0.11 | 0.10 |
| 2000th print | Sample 1 | −0.12 | −0.07 | −0.11 | −0.35 | −0.30 | −0.40 | 0.10 | 0.05 | 0.10 |
| | Sample 2 | −0.20 | −0.10 | −0.15 | −0.40 | −0.40 | −0.40 | 0.25 | 0.18 | 0.11 |
| | Sample 3 | −0.25 | −0.11 | −0.25 | −0.42 | −0.43 | −0.48 | 0.25 | 0.15 | 0.13 |
| | Sample 4 | −0.13 | −0.08 | −0.13 | −0.33 | −0.38 | −0.41 | 0.12 | 0.08 | 0.09 |

It is evident from the results that the material produced with the coupler according to the invention has resistance to under-replenishment and the accumulation of harmful impurities in the developer which is comparable to that of a material which is produced using a conventional cyan coupler of the 2-acylamino-5-ethylphenol type, while the material produced with a two-equivalent cyan coupler not according to the invention of the pyrrolo[1,2-b](1,2,4)-triazole type with a simple carbamate fugitive group exhibits clear disadvantages, in particular a severe fall in gradation with an increase in fog. The magenta and yellow colour separations are also affected.

The four-equivalent cyan coupler of the pyrrolo(1,2,4)-triazole type exhibits more favourable processing stability, but a higher application rate must be used.

| AP94 process: | |
|---|---|
| a) Colour developer - 45 s - 35° C. | |
| Triethanolamine | 9.0 g |
| N,N-diethylhydroxylamine | 4.0 g |
| Diethylene glycol | 0.05 g |
| 3-methyl-4-amino-N-ethyl-N-methanesulfonaminoethylaniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-dihydroxybenzene-3,4,6-trisulfonic acid, trisodium salt makeup to 1000 ml with water; pH 10.0 | 0.3 g |
| b) Bleach/fixing bath - 45 s - 35° C. | |
| Ammonium thiosulfate | 75 g/l |
| Sodium hydrogen sulfite | 13.5 g/l |
| Ammonium acetate | 2.0 g/l |
| Ethylenediaminetetraacetic acid (iron/ammonium salt) | 57 g/l |
| Ammonia, 25 wt. - % | 9.5 g/l |
| Acetic acid | 9.0 g/l |
| make up to 1000 ml with water; pH 5.5 | |
| c) Rinsing - 2 min - 35° C. | |
| d) Drying | |

What is claimed is:

1. A color photographic material which comprises on a support at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler together with non-photosensitive layers, an the cyan coupler, of which there is at least one, is of the formula (II)

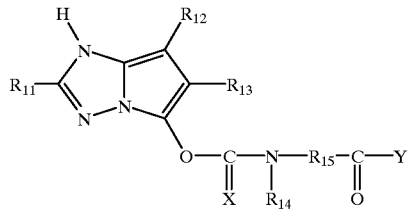

in which $R_{11}$ means an alkyl, aryl, acylamino, alkylcarbamoyl, arylcarbamoyl or a heterocyclic group, $R_{12}$ means a group having electron-attracting characteristics, $R_{13}$ means a group having electron-attracting characteristics, $R_{14}$ means an allyl or aryl group, $R_{15}$ means a divalent linking member having 2 to 4 linking atoms, X means =O or =N—$SO_2R_{21}$, $R_{21}$ is a ballast group and Y means a group eliminable by hydrolytic or intramolecular (nucleophilic) attack.

2. The color photographic material according to claim 1, wherein

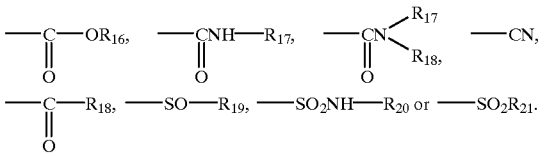

$R_{13}$ means a cyano, alkoxycarbonyl or aryloxycarbonyl group $R_{15}$ means an ethylene or trimethylene group, $R_{16}$, $R_{17}$, $R_{18}$, $R_{19}$, $R_{20}$, and $R_{21}$ mutually independently means ballast groups, Y means an alkoxy or aryloxy group or a group of the formulae

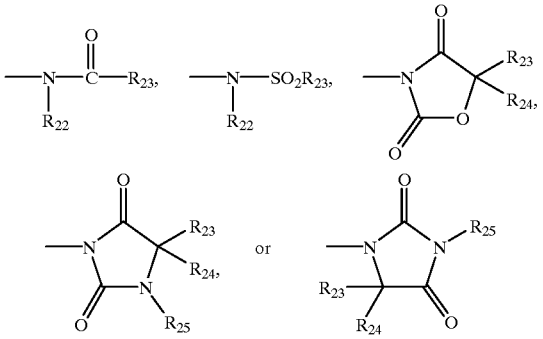

X means O and $R_{22}$, $R_{23}$, $R_{24}$, and $R_{25}$ mutually independently mean alkyl groups or, in pairs, mean alkylenne groups.

3. The photographic material according to claim 1, wherein the cyan coupler is of the formula III:

(III)

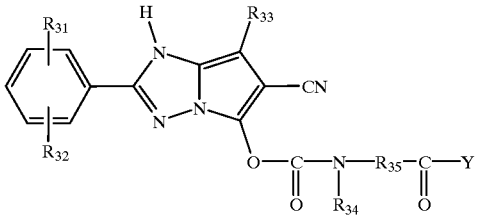

in which $R_{31}$ and $R_{32}$ mutually independently are a substituent, $R_{33}$ is —$COOR_{36}$ or CN, $R_{34}$ is $C_1$–$C_4$ alkyl, $R_{35}$ is $C_2$–$C_4$-akylene and $R_{36}$ is an aliphatic group having at least 8 C atoms and Y has the above-stated meaning.

4. The photographic material according to claim 1, wherein the cyan coupler is of the formula

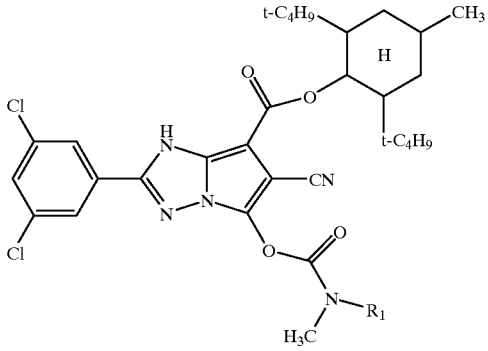

wherein $R_1$ is —$(CH_2)_2COOCH_3$, —$CH(CH_3)CH_2COOCH_3$, —$(CH_2)_3COOCH_3$, —$(CH_2)_2COOCH_2CF_3$, —$(CH_2)_2COOCH_2$-phenyl, —$(CH_2)_2CON(CH_3)SO_2$-phenyl, —$(CH_2)_2COOCH_3$,

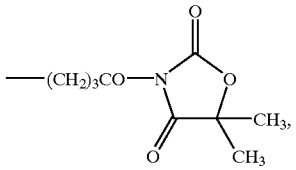

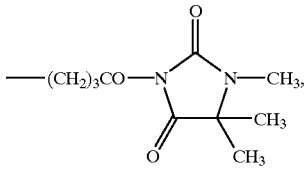

—$(CH_2)_3CON(CH_3)COOCH_3$

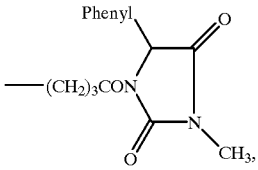

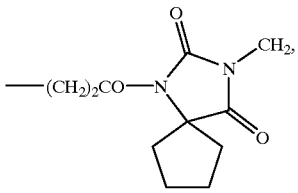

or —$(CH_2)_2CON(CH_3)SO_2N(CH_3)_2$.

* * * * *

UNITED STATES PATENT AND TRADEMARK OFFICE

CERTIFICATE OF CORRECTION

PATENT NO. : 6,150,079
DATED : November 21, 2000
INVENTOR(S) : Peter Bergthaller It is certified that error appears in the above-identified patent and that said Letters Patent is hereby corrected as shown below:

Column 32, line 24 (claim1, line 7), "an" should read - - and - -.

Column 32, line 55 (claim 2, line 3), "$R_{12}$ is" should be inserted.

Signed and Sealed this

Eighth Day of May, 2001

*Attest:*

Nicholas P. Godici

NICHOLAS P. GODICI

*Attesting Officer*

*Acting Director of the United States Patent and Trademark Office*